US005087802A

United States Patent [19]

Guilleminot

[11] Patent Number: 5,087,802

[45] Date of Patent: Feb. 11, 1992

[54] RETAINING DEVICE FOR A CONTROL BUTTON OF THE PIANO-KEY TYPE AND DEVICE IN WHICH SAME IS USED

[75] Inventor: Pierre Guilleminot, Rambouillet, France

[73] Assignee: U.S. Philips Corporation, New York, N.Y.

[21] Appl. No.: 558,114

[22] Filed: Jul. 20, 1990

[30] Foreign Application Priority Data

Jul. 21, 1989 [FR] France ..... 89 09884

[51] Int. Cl.[5] ..... H01H 13/70; H01H 3/12

[52] U.S. Cl. ..... 200/343; 200/341

[58] Field of Search ..... 200/343, 342, 341, 344, 200/345, 314, 331, 520, 557

[56] References Cited

U.S. PATENT DOCUMENTS 3,800,104 3/1974 Lien et al. ..... 200/461
4,786,766 11/1988 Kobayashi ..... 200/517
4,967,467 11/1990 Udagawa .

*Primary Examiner*—Henry J. Recla
*Assistant Examiner*—David J. Walczak

[57] ABSTRACT

Retaining device for a control button of the piano-key type and device in which same is used.

A control button TO of the piano-key type is fixed on a support SU by means of three elastic strips L1, LC, L2, one strip LC comprising a catch BE which snaps itself into place after being introduced into the opening ET of the support.

Application: Audio, video devices, particularly car radios.

5 Claims, 1 Drawing Sheet

RETAINING DEVICE FOR A CONTROL BUTTON OF THE PIANO-KEY TYPE AND DEVICE IN WHICH SAME IS USED

BACKGROUND OF THE INVENTION

1. Field of the Invention

The invention relates to a retaining device for a control button on a support, which button has a liberty of movement of the piano-key type with a rest position and an actuating position, comprising positioning means for positioning the button on the support in the rest position ans returning means for returning the button to the rest position after an actuating operation consisting of pressing of the button.

2. Description of the Related Art

Control buttons are used in audio and video devices, especially in car radios for achieving the various settings: treble/bass, volume, balance; such a button bears, for example, on a microswitch which delivers a pulse each time pressure is exerted on the button. In all cases, the retaining system of the button is subject to functional and aesthetic constrains, i.e.: a great number of operations, precision of positioning relative to the decorative front, possibility of illumination from the interior of the device, absence of mechanical noise and vibrations.

Such buttons are often present in numbers and installed side by side with mounting rods and return springs, which is complicated and expensive.

The present invention has for its object to eliminate these disadvantages.

SUMMARY OF THE INVENTION

According to the present invention, a retaining system as described in the opening paragraph is characterized in that the said support is provided with an opening in the shape of a flattened T all through its thickness, in that said button is provided with 3 contiguous strips situated in a plane substantially perpendicular to the button and made of an elastic material, the central strip being provided with a catch which is removed from the button by a distance which is at least equal to the thickness of the support, whereby after elastic penetration of the central strip in the leg of the T and, simultaneously, of the two lateral strips in the wings of the T, the catch steps itself around the support and thus constitutes the said positioning means, while the two lateral strips bear on the wings of the T, thus constituting the said returning means.

Such a system based on the elastic hinge principle is very simple, inexpensive, and easy to mount or to dismantle.

Advantageously, it comprises tensioning means to put the said elastic strips under tension in such a way that the positioning in the rest position is without play.

Thus, when the system is subjected to vibrations, as is particularly the case in car radios, it will not produce mechanical noise.

Preferably, the said tensioning means are formed by an additional thickness disposed on the central strip.

Avantageously, the two lateral strips are each provided with a butt end for positioning the button to the correct depth.

In a preferred embodiment, the said button comprises moreover a lower positioning bracket of elastic material substantially perpendicular to the button and provided with a retaining catch for accurate determination of the rest position by cooperation with a support opening.

Thus the button is to a certain extent subjected to a second pre-tensioning which ensures a perfect reproducibility of the rest position; this is essential in the general case in which the button is a piece of synthetic material manufactured in a mould having several cavities and when several buttons are mounted side by side.

BRIEF DESCRIPTION OF THE DRAWINGS

The present invention will now be explained in more detail below with reference to the following drawings.

DETAILED DESCRIPTION OF THE PREFERRED EMBODIMENTS

Figure 1:
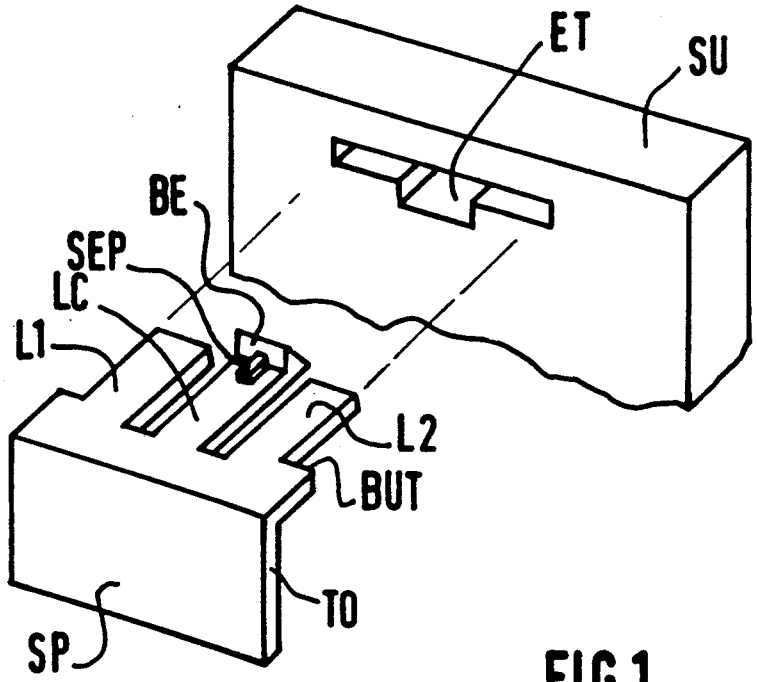
FIG. 1 depicts the inventive button and support when disassembled.

In FIG. 1, the button TO and its support SU are shown before assembly.

The support SU comprises an opening ET in the shape of a flattened T throughout its entire thickness.

The button TO is operated by pressing on the surface SP; this surface may obviously have various outward appearances different from the one represented here.

The button is provided with 3 strips L1, LC, L2 substantially perpendicular to the button and having a thickness small enough for the strips to be elastic.

The thickness of the side wings of the T of the support is slightly greater than the thickness of the lateral strips L1 and L2, so that the latter may enter the former with minimal play; to facilitate the insertion of the button it is possible to bevel the ends of the strips L1, L2 slightly, both in the direction of their thickness and in the direction of their width.

The central strip LC is provided at its free end with a catch BE designed to snap itself behind the support SU; to this end, it is not greater than the leg of the T so that, during assembly of the system, the central strip is bent down to let the catch BE pass, and then springs back into place to form the snap connection.

The lateral strips are here provided with lateral butt ends BUT which prevent the button TO being pushed too far into the support SU, so that the button is positioned at the correct depth by the catch BE and the butt ends BUT; alternative arrangements of the butt ends are also possible.

In a modfication not shown there is a possibility of providing the catch so that it faces downwards, in which case the leg of the T points upwards. Since the button is operated in downward direction, the arrangement of FIG. 1 is nevertheless preferred since the catch does not have the tendency to disengage itself in this way.

In FIG. 1, the central strip LC has a slight additional thickness SEP at the side of the catch; after assembly this additional thickness slightly spaces the central strip LC away from the upper wall of the T, which results in the elastic strips being pre-stressed. Thus the button does not rattle in its holder in case of vibrations.

Figure 2:
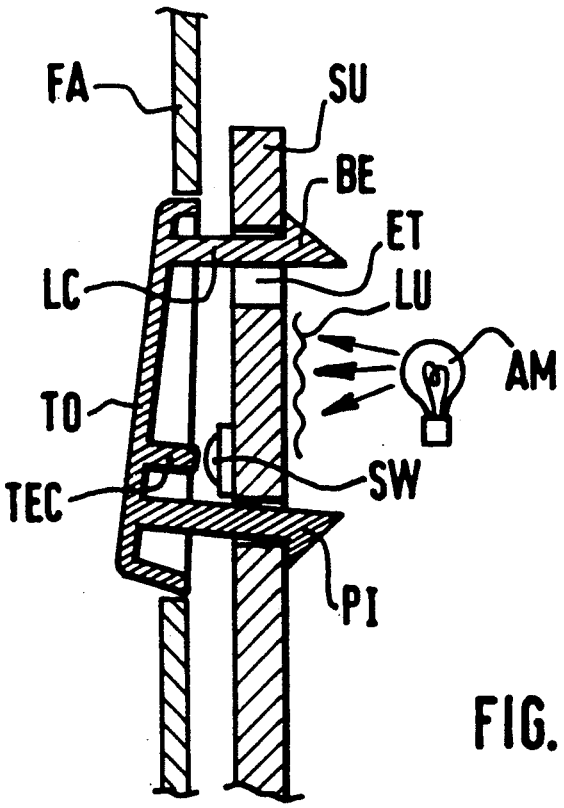
FIG. 2 depicts, in cross-section, the inventive button and support when assembled.

In FIG. 2, the system is shown in cross-section after assembly.

FIG. 2 shows an actual assembly example, whereas FIG. 1 is concerned with showing the operating principle. In addition to the button TO and the support SU, a decorative front FA is shown; the front and the support may form a single component without the principle of the retaining system according to the invention being modified.

The button TO in FIG. 2 has an outward appearance—rounded edges with skirt—which is more "commercial" than that of FIG. 1, but functionally it is the same. The central strip LC with its catch BE is retained in the opening ET of the support SU. The lateral strips are not visible in FIG. 2. The position shown is the rest position.

When pressure is exerted on the button, the actuating stub TEC operates the switch SW. They are here represented diagrammatically to show that only a short path is necessary to realise the movement function of the piano-key type. The elastic strips constitute the returning means from the actuating position to the rest position.

The button TO of FIG. 2 also comprises a lower bracket PI which, similar to the catch BE, will snap itself into the support SU. The sole function of the bracket PI, however, is to fix with precision the rest position, since it is designed to tension the elastic strips to a not excessive degree. In fact, if the bracket PI should be absent, the position of the button TO relative to the front FA could be different from one button to another owing to manufacturing deviations, especially with moulds having several cavities.

With the bracket PI and the strips which retain its catch secured against the support, the overlap line of the button relative to the front is perfectly defined and reproducible.

As an indicative example, such a retaining system has been realised with a button of 15×15 mm made of synthetic material with strips having a thickness of 0.7 mm, a width of 2.5 mm, and a length of 6 mm.

It is to be noted that the retaining system according to the invention occupies little space and thus renders it possible to illuminate the button from behind with, for example, a light bulb AM.

It is sufficient for this that the support zone marked LU is empty, or translucent, so that the light emitted by the bulb AM illuminates the button from behind to render visible an inscription or a picture.

I claim:

1. A combination of a control button and a support for the button, which button has an operating surface and a liberty of movement of the piano-key type with a rest position and an actuating position, comprising positioning means for positioning the button in spaced relation with respect to the support in the rest position and returning with respect to the support in the rest position and returning means for returning the button to the rest position after an actuating operation consisting of pressing of the button, characterized in that the support is provided with an opening in the shape of a flattened T extending through its thickness, and said button is provided with 3 contiguous strips including a central strip and two lateral strips situated in a plane substantially perpendicular to the operating surface of said button and made of an elastic material, the central strip being provided with a catch which is removed from the button by a distance which is at least equal to the thickness of the support and the distance of the button from the support, said central strip being inserted in the leg of the T and, simultaneously, said two lateral strips being inserted in the wings of the T, and the catch being snapped around the support thereby constituting said positioning means, while the two lateral strips bear on the wings of the T, thus constituting said returning means.

2. A combination as claimed in claim 1, characterized in that said combination further comprises tensioning means to put the said elastic strip under tension is such a way that the positioning in the rest position is without play.

3. A combination as claimed in claim 2, characterized in that the said tensioning means includes an additional thickness disposed on the central strip.

4. A combination as claimed in claim 1, characterized in that said positioning means comprises the two lateral strips each provided with a butt end for positioning the button to the correct depth.

5. A combination as claimed in claim 1, characterized in that the support includes a second support opening and said button comprises a lower positioning bracket of elastic material disposed opposite said contiguous strips substantially perpendicular to the operating surface of said button and provided with a retaining catch, said lower bracket being for accurate determination of said rest position by cooperation with said second support opening.

* * * * *